US007229005B2

(12) United States Patent
Miyazawa

(10) Patent No.: US 7,229,005 B2
(45) Date of Patent: Jun. 12, 2007

(54) DISPLAY DEVICE HAVING AN IMPROVED VIDEO SIGNAL DRIVE CIRCUIT

(75) Inventor: Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 146 days.

(21) Appl. No.: 10/147,226

(22) Filed: May 17, 2002

(65) Prior Publication Data

US 2002/0175926 A1 Nov. 28, 2002

(30) Foreign Application Priority Data

May 25, 2001 (JP) ..... 2001-156718

(51) Int. Cl.
*G09G 3/36* (2006.01)

(52) U.S. Cl. ..... 234/98; 345/206

(58) Field of Classification Search ..... 345/89, 345/98, 100, 690, 80, 99, 206
See application file for complete search history.

(56) References Cited

U.S. PATENT DOCUMENTS 5,414,443 A * 5/1995 Kanatani et al. ..... 345/95
5,534,885 A * 7/1996 Saitoh ..... 345/100
5,784,041 A * 7/1998 Okada et al. ..... 345/89
6,281,891 B1 * 8/2001 DaCosta et al. ..... 345/206
6,323,836 B1 * 11/2001 Shin ..... 345/99
6,498,596 B1 * 12/2002 Nakamura et al. ..... 345/98
6,621,547 B2 * 9/2003 Kang ..... 349/151

* cited by examiner

*Primary Examiner*—Kevin M. Nguyen
(74) *Attorney, Agent, or Firm*—Antonelli, Terry, Stout & Kraus, LLP.

(57) ABSTRACT

A display device has a video circuit for pixels arranged in a matrix. The video circuit includes a digital data store section; a transfer-data processing section for generating a data signal at a time assigned to one of gray scale levels for the data in synchronism with a supplied clock; a gray-scale voltage generator for generating gray-scale voltages; a selection gate circuit for successively generating gate pulses associated with the gray-scale voltages, in synchronism with the clock; and a gray-scale voltage selector circuit for receiving the data signal via a selection-data transfer line provided for each of plural columns of the pixels, and for successively selecting the gray-scale voltages from the gray-scale voltage generator, in synchronism with the gate pulses. The gray-scale voltage selector circuit outputs as the video signal, one of the gray-scale voltages selected from the successively selected gray-scale voltages in synchronism with the data signal.

17 Claims, 10 Drawing Sheets

DISPLAY DEVICE HAVING AN IMPROVED VIDEO SIGNAL DRIVE CIRCUIT

BACKGROUND OF THE INVENTION

The present invention relates to a display device, and in particular, to a display device having improved its video signal drive circuit section.

For example, a display device such as a liquid crystal device includes a plurality of pixels arranged in a matrix array, a circuit for selecting one from a plurality of pixel rows each comprising a plurality of pixels arranged in the x-direction, and a circuit for providing a video signal to each of the pixels in the selected pixel row in synchronism with the selection of the pixel row.

Specifically, a liquid crystal layer is sandwiched between two opposing substrates, fabricated on a liquid-crystal-layer-side surface of one of the two substrates are a plurality of gate signal lines extending in the x direction and arranged in the y direction and a plurality of drain signal lines extending in the y direction and arranged in the x direction, and each of areas surrounded by two adjacent ones of the gate signal lines and two adjacent ones of the drain signal lines serves as a pixel area.

Each of the pixel areas is provided with a thin film transistor driven by a scanning signal from one of the gate signal lines and a pixel electrode supplied with a video signal from a corresponding one of the drain signal lines via the thin film transistor. The gate signal lines are supplied with the scanning signals successively so as to select one from the plural pixel rows each comprising plural pixels arranged in the x direction, and in synchronism with this selection, each of the drain signal lines supplies a video signal voltage to a corresponding one of the pixel electrodes.

Each of the drain signal lines is connected to a video signal drive circuit. The video signal drive circuit is supplied with information formed of a certain number of bits representing a gray scale, selects gray scale voltages in accordance with the information and applies the gray scale voltages to the drain signal lines.

SUMMARY OF THE INVENTION

In such conventional display devices, for displaying the number n of gray scale levels, the number n of signal lines have been required so as to operate n switching elements each assigned to one of the n gray scale levels, respectively. Recently it has been pointed out that, in a case where the video signal drive circuit as well as the pixels is fabricated on the same substrate, it has become difficult to lay out the video signal drive circuit in a limited area on the substrate due to a recent tendency toward higher display definition.

The present invention has been made in view of the above situation, and it is an object of the present invention to provide a display device having a video signal drive circuit capable of being fabricated in a limited space and selecting from among a plurality of gray scale voltages represented by a large number of data bits.

The following explains the representative ones of the present inventions disclosed in this specification briefly.

In accordance with an embodiment of the present invention, there is provided a display device comprising: a plurality of pixels arranged in a matrix array; a selector circuit for selecting one from a plurality of rows of pixels in the matrix array; and a video signal supplying circuit for supplying a video signal representing a gray-scale information to each of pixels in the selected row in synchronism with the selection of the selected row, wherein the video signal supplying circuit is provided with a transfer-data processing section for generating a data signal at a time assigned to a gray scale level, in accordance with n-bit data information representing the gray scale level, and a gray-scale voltage selector circuit section for supplying as the video signal, a piece of gray scale information selected from among plural pieces of gray-scale information, based upon the time associated with the data signal, the plural pieces of gray-scale information being successively selected.

In accordance with another embodiment of the present invention, there is provided a display device comprising: a plurality of pixels arranged in a matrix array; a selector circuit for selecting one from a plurality of rows of pixels in the matrix array; and a video signal supplying circuit for supplying a video signal to each of pixels in the selected row in synchronism with the selection of the selected row, wherein the video signal supplying circuit is provided with a transfer-data processing section for generating a data signal at a time assigned to a gray scale level, in accordance with n-bit data information representing the gray scale level, and a gray-scale voltage selector circuit section for supplying as the video signal, a voltage signal selected from among a plurality of gray-scale voltages, based upon the time associated with the data signal, the plurality of gray-scale voltages being successively selected.

In accordance with another embodiment of the present invention, there is provided a display device comprising: a plurality of pixels arranged in a matrix array; a selector circuit for selecting one from a plurality of rows of pixels in the matrix array; and a video signal supplying circuit for supplying a video signal to each of pixels in the selected row in synchronism with the selection of the selected row, wherein the video signal supplying circuit is provided with a transfer-data processing section for generating a data signal at a time assigned to a gray scale level, in accordance with n-bit data information representing the gray scale level, and a gray-scale voltage selector circuit section for supplying as the video signal, a voltage signal selected from among a plurality of gray-scale voltages, by time coincidence between the gray scale level by successive selection of a plurality of gate lines each coupled to a switching circuit associated with one of the plurality of gray-scale voltages and the data signal supplied to the switching circuit from the transfer-data processing section.

In accordance with another embodiment of the present invention, there is provided a display device comprising: a plurality of pixels arranged in a matrix array; a selector circuit for selecting one from a plurality of rows of pixels in the matrix array; and a video signal supplying circuit for supplying a video signal to each of pixels in the selected row in synchronism with the selection of the selected row, the video signal supplying circuit comprising: a digital data store section for storing n-bit data information for each of the plurality of pixels; a transfer-data processing section for generating a data signal at a time assigned to one of a plurality of gray scale levels represented by the n-bit data information, in synchronism with a clock waveform supplied to the transfer-data processing section; and a gray-scale voltage selector circuit section for successively selecting a plurality of gray-scale voltages corresponding to the plurality of gray scale levels, respectively, in synchronism with the clock waveform, wherein the gray-scale voltage selector circuit section outputs as the video signal, one of the plurality of gray-scale voltages selected from the successively selected gray-scale voltages at the time associated with the data signal.

In accordance with another embodiment of the present invention, there is provided a display device comprising: a plurality of pixels arranged in a matrix array; a selector circuit for selecting one from a plurality of rows of pixels in the matrix array; and a video signal supplying circuit for supplying a video signal to each of pixels in the selected row in synchronism with the selection of the selected row, the video signal supplying circuit comprising: a digital data store section for storing n-bit data information for each of the plurality of pixels; a transfer-data processing section for generating a data signal at a time assigned to one of a plurality of gray scale levels represented by the n-bit data information, in accordance with an output from the digital data store section, in synchronism with a clock waveform supplied to the transfer-data processing section; a gray-scale voltage generator for generating a plurality of gray-scale voltages corresponding to the plurality of gray scale levels, respectively; a selection gate circuit for successively generating a plurality of gate pulses associated with the plurality of gray-scale voltages, respectively, in synchronism with the clock waveform; and a gray-scale voltage selector circuit section for successively selecting the plurality of gray-scale voltages, in synchronism with the gate pulses, wherein the gray-scale voltage selector circuit section outputs as the video signal, one of the plurality of gray-scale voltages selected from the successively selected gray-scale voltages at the time associated with the data signal.

In accordance with another embodiment of the present invention, there is provided a display device comprising: a plurality of pixels arranged in a matrix array; a selector circuit for selecting one from a plurality of rows of pixels in the matrix array; and a video signal supplying circuit for supplying a video signal to each of pixels in the selected row in synchronism with the selection of the selected row, the video signal supplying circuit comprising: a digital data store section for storing n-bit data information for each of the plurality of pixels; a transfer-data processing section for generating a data signal at a time assigned to one of a plurality of gray scale levels represented by the n-bit data information, in accordance with an output from the digital data store section, in synchronism with a clock waveform supplied to the transfer-data processing section; a gray-scale voltage generator for generating a plurality of gray-scale voltages corresponding to the plurality of gray scale levels, respectively; a selection gate circuit for successively generating a plurality of gate pulses associated with the plurality of gray-scale voltages, respectively, in synchronism with the clock waveform; and a gray-scale voltage selector circuit section for receiving the data signal via a selection-data transfer line provided for each of a plurality of columns of pixels in the matrix array, and for successively selecting the plurality of gray-scale voltages generated by the gray-scale voltage generator, in synchronism with the gate pulses, wherein the gray-scale voltage selector circuit section outputs as the video signal, one of the plurality of gray-scale voltages selected from the successively selected gray-scale voltages in synchronism with the data signal.

In accordance with another embodiment of the present invention, there is provided a display device comprising: a plurality of pixels arranged in a matrix array; a selector circuit for selecting one from a plurality of rows of pixels in the matrix array; and a video signal supplying circuit for supplying a video signal to each of pixels in the selected row in synchronism with the selection of the selected row, the video signal supplying circuit comprising: a digital data store section for storing n-bit data information for each of the plurality of pixels; a transfer-data processing section for generating a data signal at a time assigned to one of a plurality of gray scale levels represented by the n-bit data information, in accordance with an output from the digital data store section, in synchronism with a clock waveform supplied to the transfer-data processing section; a gray-scale voltage generator for generating a plurality of gray-scale voltages corresponding to the plurality of gray scale levels, respectively; a selection gate circuit for successively generating a plurality of gate pulses associated with the plurality of gray-scale voltages, respectively, in synchronism with the clock waveform; and a gray-scale voltage selector circuit section for receiving the data signal via one of a plurality of selection-data transfer lines, the plurality of selection-data transfer lines being provided for each of a plurality of columns of pixels in the matrix array, and for successively selecting the plurality of gray-scale voltages generated by the gray-scale voltage generator, in synchronism with the gate pulses, each of the plurality of selection-data transfer lines corresponding to one of a plurality of groups formed by dividing the plurality of gray-scale voltages, wherein the gray-scale voltage selector circuit section outputs as the video signal, one of the plurality of gray-scale voltages selected from the successively selected gray-scale voltages in synchronism with the data signal.

BRIEF DESCRIPTION OF THE DRAWINGS

In the accompanying drawings, in which like reference numerals or characters designate similar components throughout the figures, and in which.

DETAILED DESCRIPTION OF THE PREFERRED EMBODIMENTS

Embodiments of a display device in accordance with the present invention will be explained by reference to the drawings.

Embodiment 1

Figure 1:
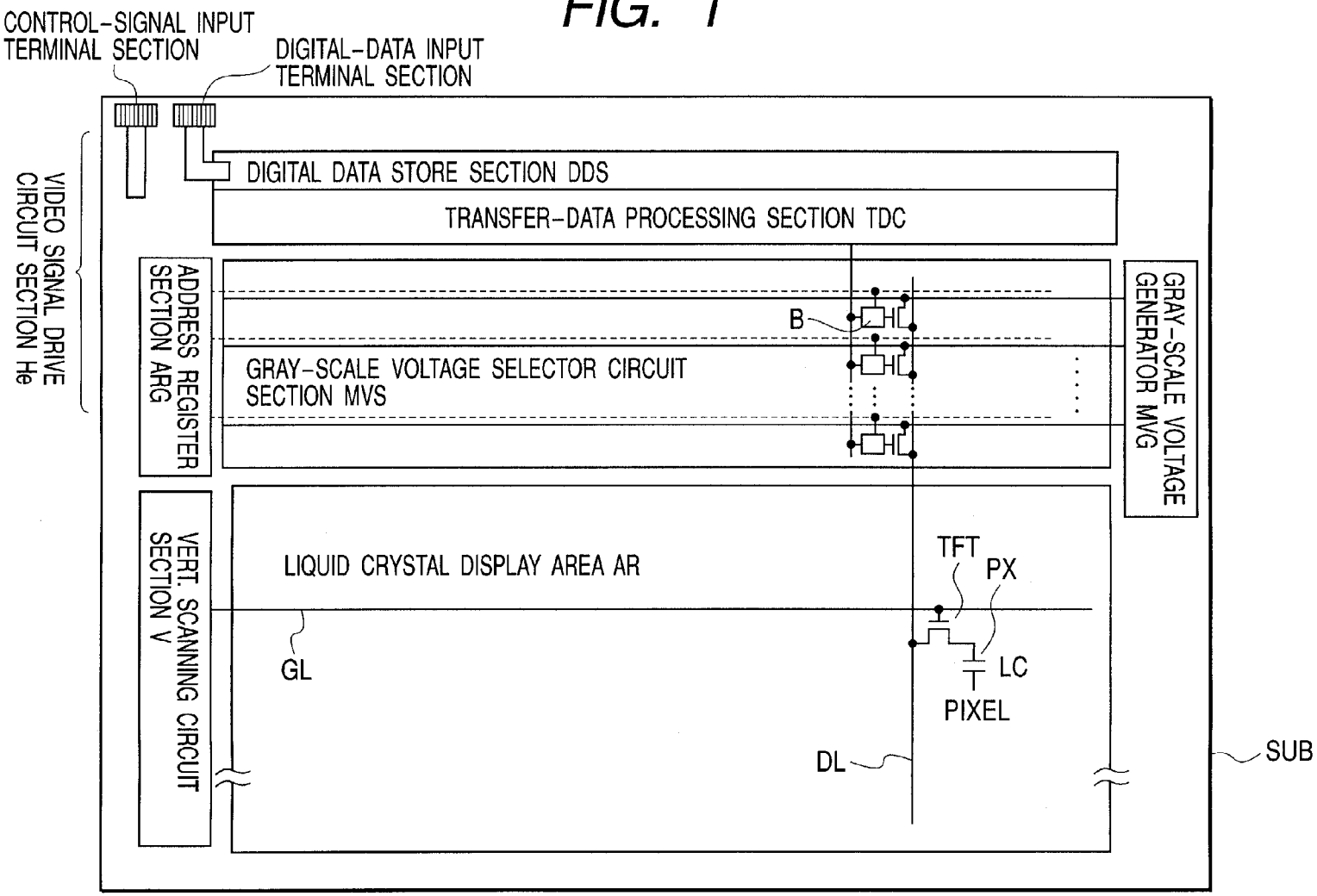
FIG. 1 is an entire equivalent circuit diagram of an embodiment of a display device in accordance with the present invention.

FIG. 1 is a plan view illustrating a liquid crystal display device as an embodiment of a display device in accordance with the present invention, and represents an equivalent circuit of a configuration formed on a liquid-crystal-layer-side surface of one substrate SUB1 of two opposing transparent substrates sandwiching a liquid crystal layer therebetween. Formed on the liquid-crystal-layer-side surface of the transparent substrate SUB1 are a liquid crystal display area AR and drive circuits formed therearound. The liquid crystal display area AR and the drive circuits are formed of lamination of conductive layers, semiconductor layers, insulating layers and others which are processed into desired fine patterns, and the semiconductor layers are formed of polysilicon (p-Si) layers, for example.

As shown in FIG. 1, fabricated in the liquid crystal display area AR are a plurality of gate signal lines GL (only one of which is shown) extending in the x direction and arranged in the y direction and a plurality of drain signal lines DL (only one of which is shown) extending in the y direction and arranged in the x direction, and each of areas surrounded by two adjacent ones of the gate signal lines GL and two adjacent ones of the drain signal lines DL serves as a pixel area.

Fabricated in each of the pixel areas are a thin film transistor TFT driven by a scanning signal from one of the gate signal lines GL and a pixel electrode PX supplied with a video signal from a corresponding one of the drain signal lines DL via the thin film transistor TFT.

The pixel electrode PX generates an electric field between the pixel electrode and a counter electrode in common for all of the pixel areas formed on a liquid-crystal-layer-side surface of the other one (not shown) of the two opposing transparent substrates, for example, and thereby controls light transmission through the liquid crystal layer. The transparent substrate SUB1 and the other one of the two opposing transparent substrates are fixed together by a sealing member formed to surround the liquid crystal display area AR and seal up the liquid crystal layer between the two substrates.

Each of the gate signal lines GL disposed in the liquid crystal display section AR extends beyond the sealing member such that its end is connected to a vertical scanning circuit V constituting the drive circuit. The vertical scanning circuit V supplies a scanning signal to each of the gate signal lines GL, successively, and thereby turns ON all the thin film transistors TFT in the pixel areas arranged along one of the scanning signal lines GL supplied with the scanning signal. Also included in the drive circuit is a video signal drive circuit He for supplying video signals to the drain signal lines DL in synchronism with turn-ON of the thin film transistors TFT associated with the drain signal lines DL. The video signals from the video signal drive circuit He are supplied to the pixel electrodes PX via the turned-ON thin film transistors TFT.

The video signal drive circuit He is composed of a digital data store section DDS for temporarily storing digital data supplied from a circuit external to the liquid crystal display device, a transfer-data processing section TDC for transferring the digital data from the digital data store section DDS to a succeeding gray-scale voltage selector circuit section MVS, and the gray-scale voltage selector circuit section MVS for supplying video signal voltages corresponding to gray scale levels to the drain signal lines DL. Connected to the gray-scale voltage selector circuit section MVS are a gray-scale voltage generator MVG for supplying a plurality of voltages each corresponding to one gray scale level and an address register section ARG for supplying signals such that one gray-scale voltage can be selected successively from among a plurality of gray-scale voltages from the gray-scale voltage generator MVG. Incidentally, in FIG. 1, the gray-scale voltage generator MVG is fabricated on the transparent substrate SUB1, but the gray-scale voltages can be supplied from a source external to the liquid crystal display device instead of employing the gray-scale voltage generator MVG.

Figure 2:
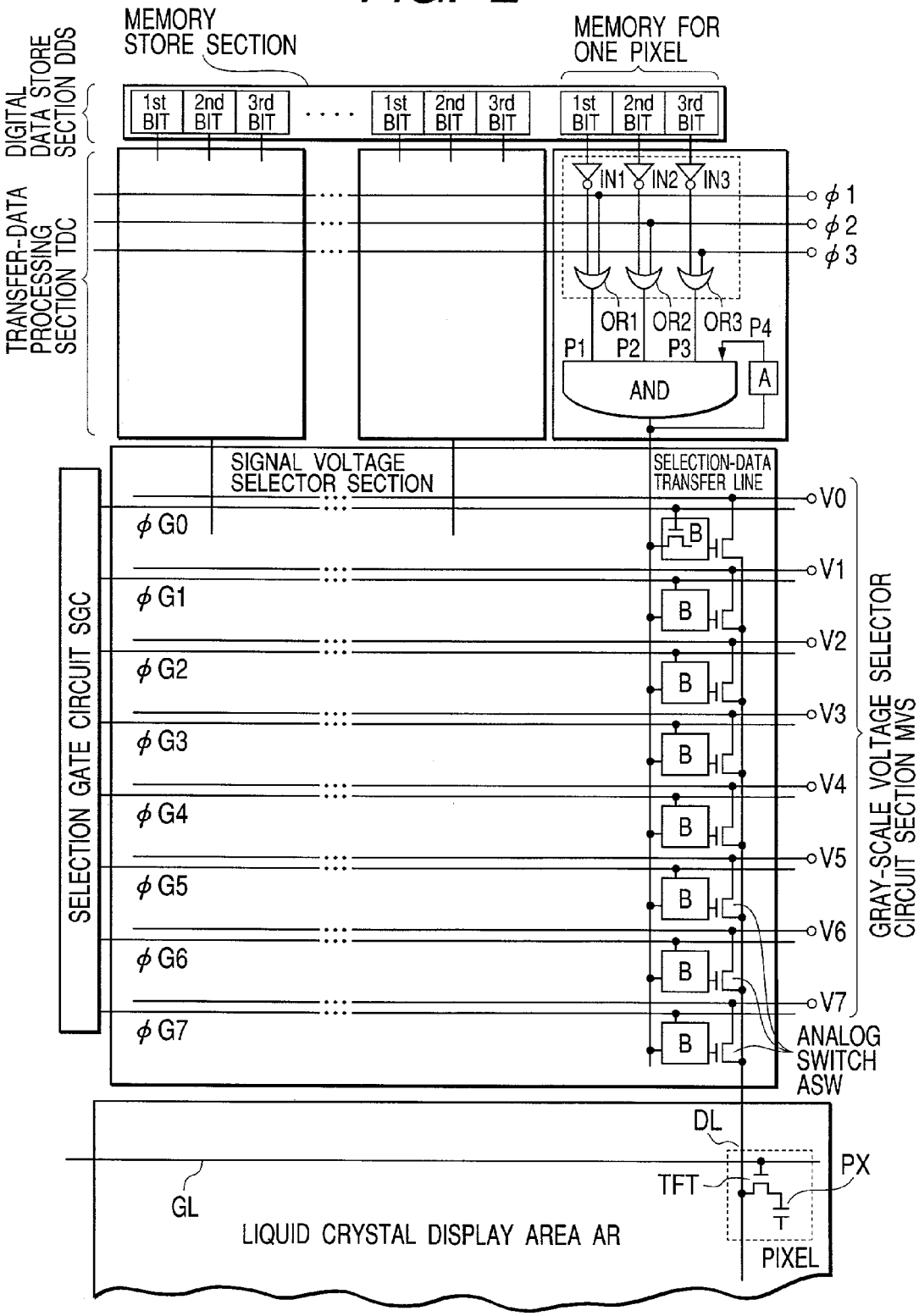
FIG. 2 is a detailed circuit diagram of an embodiment of a video signal drive circuit shown in FIG. 1.

FIG. 2 illustrates the video signal drive circuit He in greater detail, and the same reference numerals or characters as utilized in FIG. 1 designate functionally similar portions in FIG. 2. In FIG. 2, for simplicity, it is assumed that three-bit information is assigned to one pixel, and thereby a voltage corresponding to one of eight ($2^3$) gray scale levels is applied to a pixel electrode PX in each of the pixel areas.

In FIG. 2, data formed of first, second and third bits and corresponding to one pixel are stored for each of the drain signal lines DL in the digital data store section DDS. Each of the three data bits is input to one terminal of a corresponding one of three OR circuits OR1, OR2 and OR3 via a corresponding one of three inverters IN1, IN2 and IN3, simultaneously, and the other terminals of each of the OR circuits OR1, OR2 and OR3 are supplied with pulses Ø1, Ø2 and Ø3 in the order counted from the least significant bit, respectively.

Figure 3:
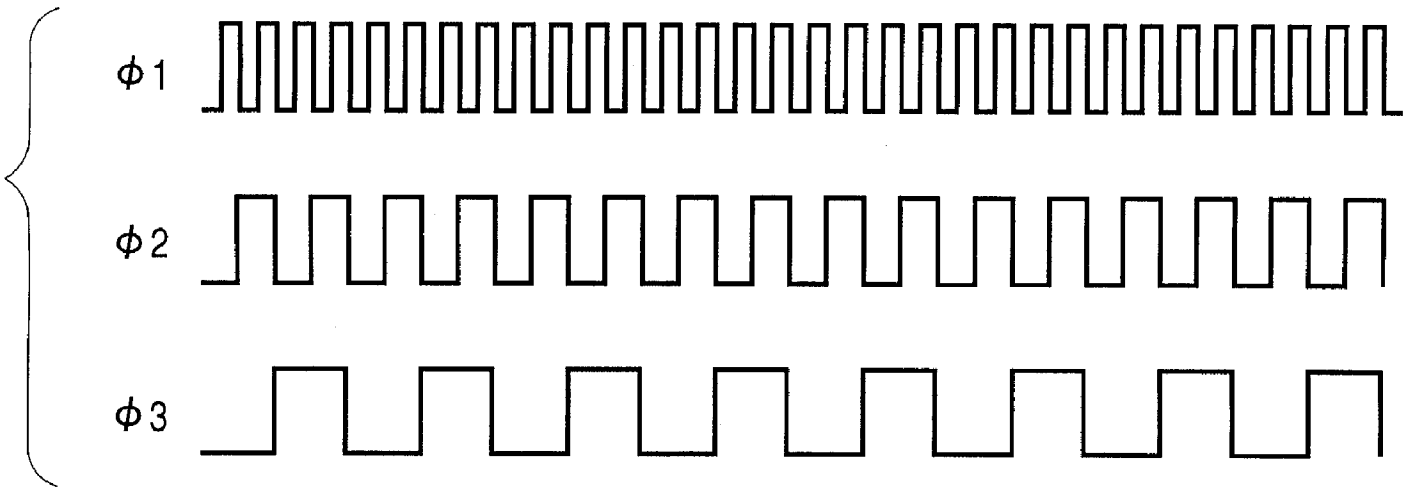
FIG. 3 illustrates pulses supplied to a transfer-data processing section of the video signal drive circuit of FIG. 2.

The pulses Ø1, Ø2 and Ø3 are alternately positive and negative (at a 50% duty cycle, for example) as shown in FIG. 3. The frequency of the pulse Ø2 corresponding to the second significant bit is twice that of the pulse Ø3 corresponding to the most significant bit, and the frequency of the pulse Ø1 corresponding to the least significant bit is twice that of the pulse Ø2 corresponding to the second significant bit.

The pulse Ø1 (the highest-frequency pulse for time-based processing) is the same as that used for selection at a selection gate circuit SGC, and scanning signals are supplied to gate signal lines ØG0–ØG7 successively in synchronism with the pulse Ø1. These symbols ØG0–ØG7 shall be used not only to designate the gate signal lines but also to specify the signals on the gate signal lines.

Outputs P1, P2 and P3 from the OR circuits OR1, OR2 and OR3, respectively, are input to an AND circuit, to which an output P4 from the AND circuit is supplied via a circuit block A.

Figure 4A:
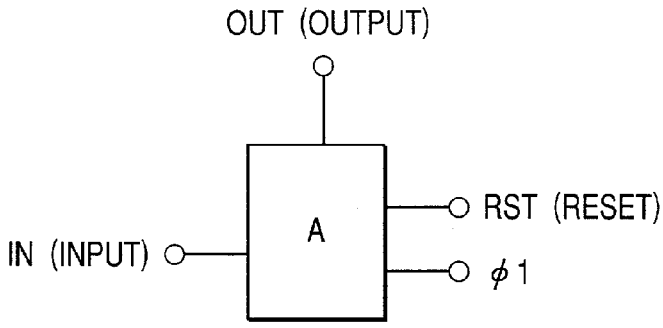
FIG. 4A illustrates an example of a circuit functionally representing a circuit block A provided in the transfer-data processing section of FIG. 2.
Figure 4B:
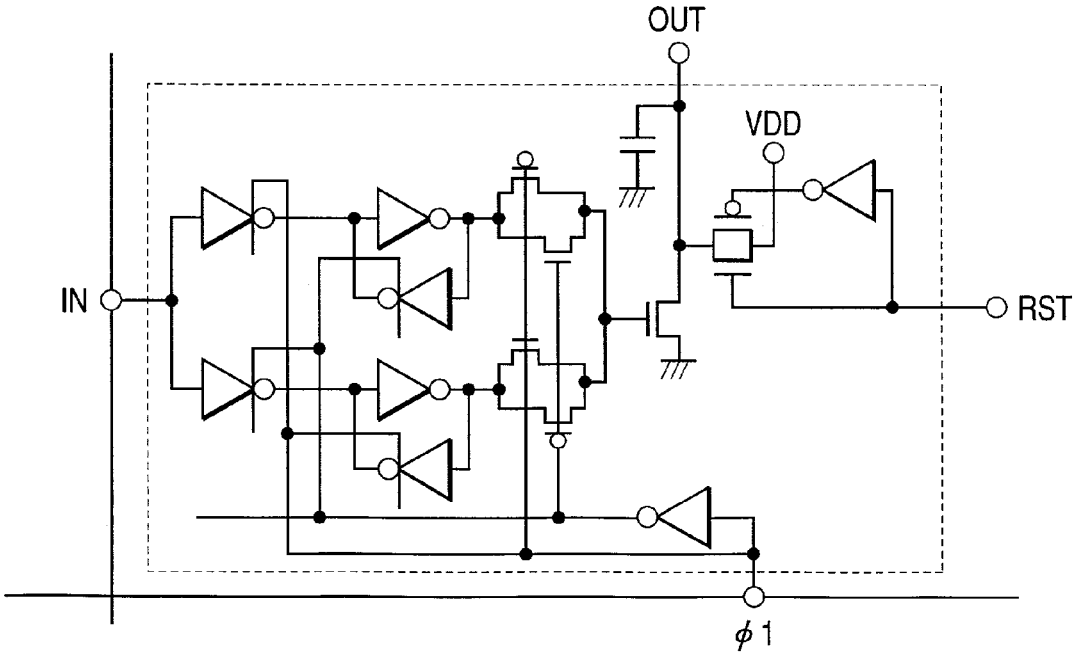
FIG. 4B is a circuit diagram of an example of a concrete circuit for the circuit block A.
Figure 4C:
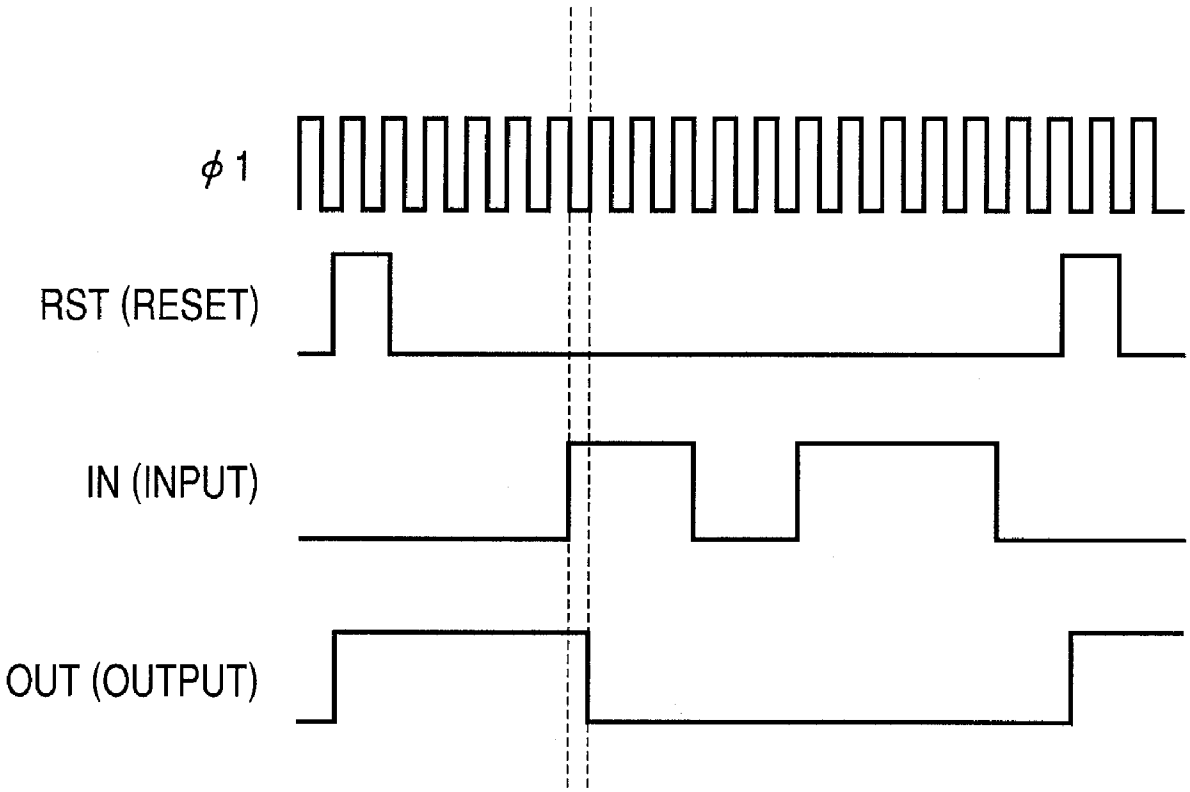
FIG. 4C is a timing chart for the circuit block A.

FIG. 4A illustrates an example of a circuit functionally representing the circuit block A, and FIG. 4B is a circuit diagram of an example of a concrete circuit for the circuit block A. The circuit block A serves to select only the first data from among a plurality of data supplied successively from the AND circuit. As shown in FIG. 4A, the circuit block A is provided with two terminals for receiving a reset signal and the pulse Ø1, respectively, in addition to input and output terminals. As shown in FIG. 4C, after the reset signal (High) is input, when the input IN is at a Low level, the output OUT changes to a High level, thereafter when the input IN changes to a High level, the output OUT remains at the High level during half the repetition period of the pulse Ø1 and then changes to a Low level and remains at the Low level until the reset signal changes to the High level again.

Returning to FIG. 2, an output from the AND circuit is input to eight of the circuit blocks B via a selection-data transfer path. The reason why the eight circuit blocks B are provided for one output from the AND circuit is that each of the eight circuit blocks selects a different one from among eight gray-scale voltages. The eight circuit blocks B are supplied with pulses ØG0, ØG1, . . . , Ø7, respectively and successively, from the selection gate circuit SGC of the address register section ARG, and only one of the eight circuit blocks B is selected and outputs a High level signal in accordance with a state of an output from the AND circuit. The output of each of the eight circuit blocks B controls the opening and closing of an analogue switch ASW between a corresponding one of gray-scale signal voltage lines each supplied with one of gray scale voltages V0, V1, V2, . . . , V7 and a corresponding one of the drain signal lines DL.

Figure 5A:
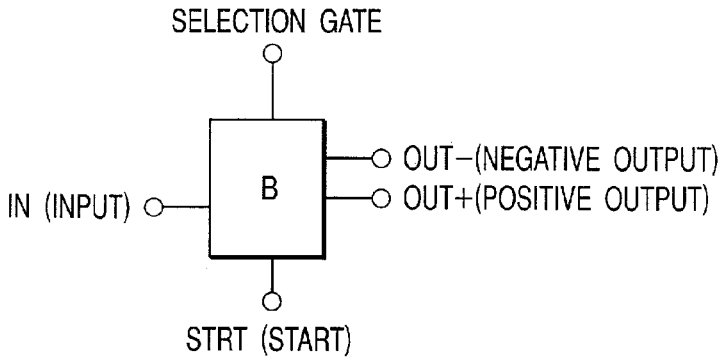
FIG. 5A displays an example of a circuit block B provided in a gray-scale voltage selector circuit section of the video signal drive circuit of FIG. 2 functionally.
Figure 5B:
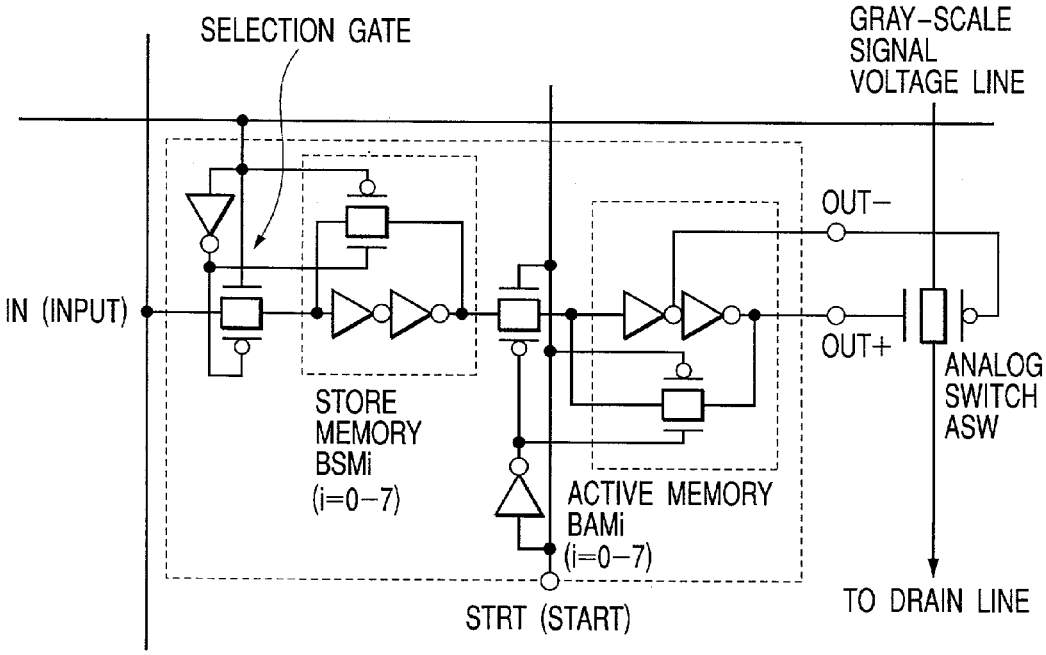
FIG. 5B illustrates an example of a concrete circuit of the circuit block B.

FIG. 5A displays an example of the circuit block B functionally, and FIG. 5B illustrates an example of a concrete circuit of the circuit block B. As shown in FIG. 5A, the circuit block B is provided with a terminal for receiving the output from the AND circuit, a terminal for receiving the selection gate signal from one of the gate signal lines ØG0–ØG7, a terminal for receiving a start signal, and a pair of output terminals.

As shown in FIG. 5B, the circuit block B is provided with a store memory BSM for inputting and storing the output from the AND circuit based upon the input of the selection gate signal, and an active memory BAM for transferring the information stored in the store memory BSM thereinto and store it therein based upon the input of the start signal STRT.

The information stored in the active memory BAM turns ON the analog switch ASW for connecting the gray-scale signal voltage line associated with the circuit block B to the drain signal line DL. A gray-scale voltage corresponding to a video signal is applied to the drain signal line DL, and then is applied to a pixel electrode PX via a thin film transistor TFT turned ON by a scanning signal from one-of the gate signal lines corresponding to the pixel electrode PX.

The feature of the liquid crystal display device having the above configuration is that only one selection-data transfer path supplies input signals to a plurality of the circuit blocks B each of which connects one of a plurality of gray-scale signal voltage lines supplying gray-scale voltages V0, V1, V2, . . . , V7, respectively, to a corresponding one of the drain signal lines DL, and consequently, this provides the advantage that he number of wiring lines in the gray-scale voltage selector circuit section MVS is greatly reduced.

Figure 5C:
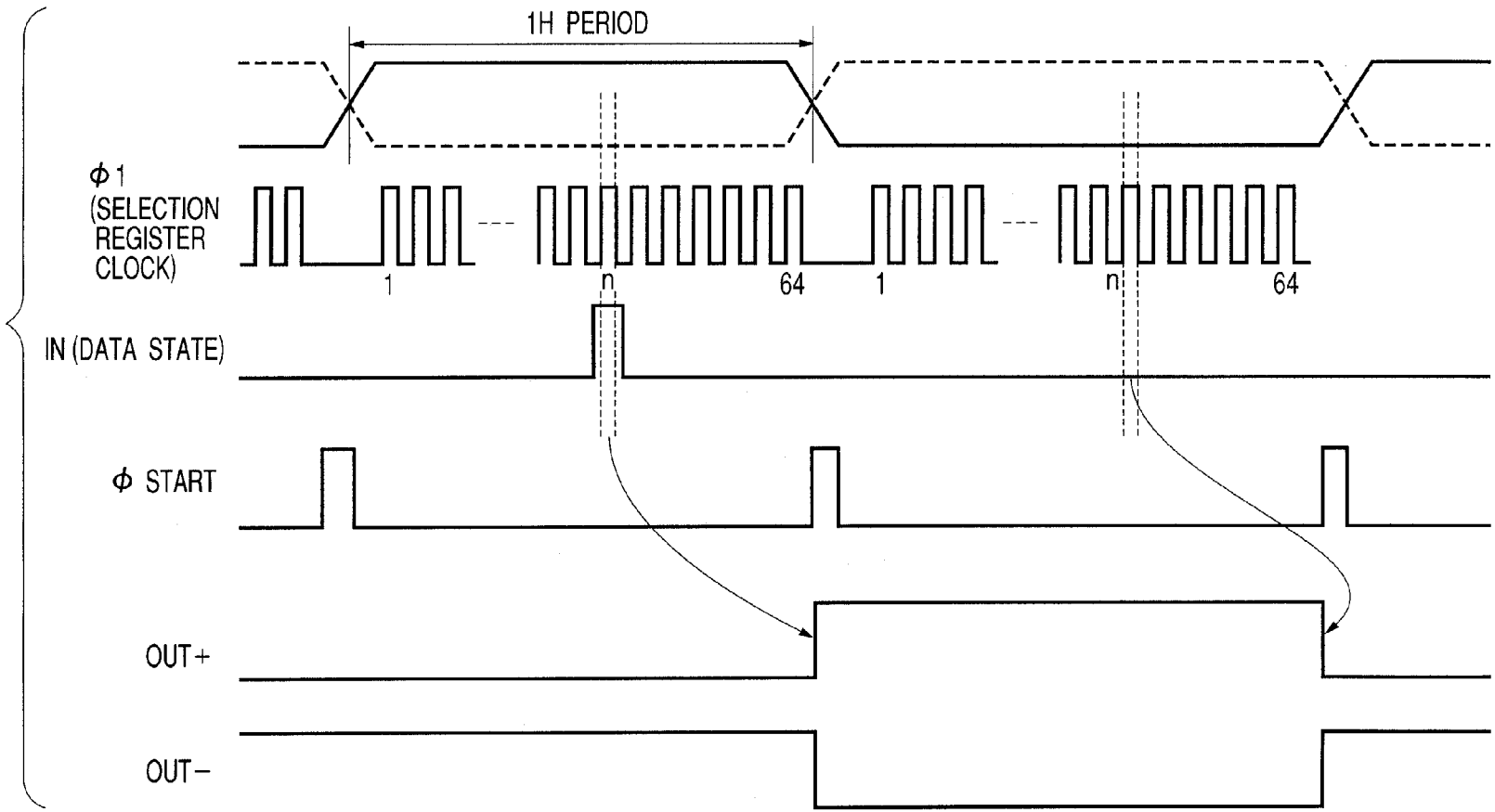
FIG. 5C illustrates timing charts of the signals during one horizontal scanning period for the circuit block B in a case where sixty-four gray scale levels are displayed, as an example.

FIG. 5C illustrates timing charts of the signals during one horizontal scanning period for a case where sixty-four gray scale levels are displayed, as an example.

In conventional gray-scale voltage selector circuit section, the disadvantage has been pointed out that, when three data bits are utilized for information for one pixel as in the present embodiment, eight ($2^3$) signal lines corresponding to the selection-data transfer lines are required, and therefore broken lines occurs easily, or a larger space for wiring is required.

Figure 6:
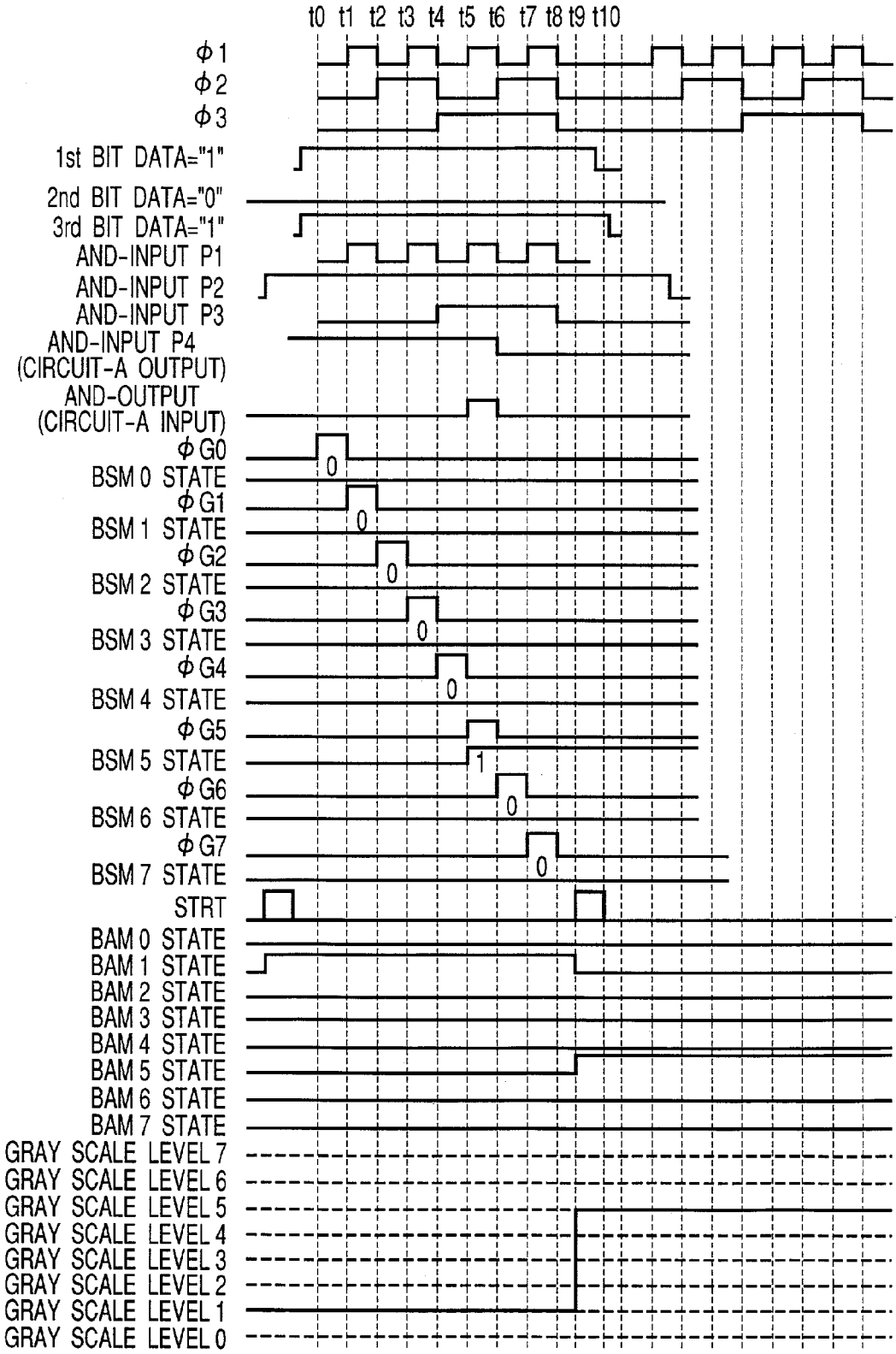
FIG. 6 is a timing chart illustrating operation of the video signal drive circuit.

The following explains operation of the liquid crystal display device having the above-explained configuration by reference to FIG. 6. It is assumed that a voltage corresponding to a gray scale level 5 is applied to the pixel electrode PX of the pixel shown in FIG. 2.

In FIG. 6, pulses Ø1, Ø2 and Ø3 are the same as the pulses for time-based processing shown in FIG. 3.

The outputs from a memory for one pixel are: the first bit data=High, the second bit data=Low, and the third bit data=High, in accordance with the bit information (1, 0, 1) representing the gray scale 5. Therefore, at time t0, the AND circuit is supplied with the pulse Ø1 for its input P1, the High level signal for its input P2, and the pulse Ø3 for its input P3, and a High level signal provided immediately after reset for its input P4. Since the Low level is present in at least one of the inputs at all times during time from t0 to t5, the output from the AND circuit remains at a Low level during the time from t0 to t5. During the time from t0 to t5, the address register ARG operates in synchronism with the pulse Ø1, and the selection gate circuit SGC supplies the pulses ØG0, ØG1, ØG2, ØG3 and ØG4 to corresponding ones of the selection gates, respectively and successively. As a result, the store memories BSM0, BSM1, BSM2, BSM3 and BSM4 of the corresponding circuit blocks B change to a Low level.

During time from t5 to t6, since all the inputs to the AND circuit are at the High level, the output of the AND circuit changes to the High level. Consequently, at this time, one of the circuit blocks B for controlling the signal voltage for the gray scale level 5 is coupled to the selection-data transfer line by the pulse ØG5, and the store memory BSM5 in this coupled circuit block B changes to the High level, and remains at the High level even after time t6 when the pulse ØG5 has changed to the Low level.

After time t6, the input P4 to the AND circuit is changed to the Low level by the function of the circuit block A, and thereafter the output of the AND circuit changes to the Low level. As a result, the store memories BSM 6 and BSM 7 in the two circuit blocks B connected to the selection-data transfer line change to the Low level.

That is to say, only the store memory BSM for controlling the signal voltage corresponding to the gray scale level 5 is at the High level, but all the remaining store memories are at the Low level. In this way the signal processing for one horizontal scanning period (the 1H period) is completed.

During time from time t9 to t10, when the start pulse (STRT) for the circuit block B changes to the High level, information in the store memory BSM in each of the circuit blocks B is transferred into its active memory BAM. Consequently, only in the circuit block B for controlling the signal voltage corresponding to the gray scale level 5, its output+(positive output terminal) changes to the High level, and its output−(negative output terminal) changes to the Low level, therefore only the output of this circuit block is in the ON state, and as a result the voltage corresponding to the gray scale level 5 is applied to the drain signal line DL.

Embodiment 2

Figure 7:
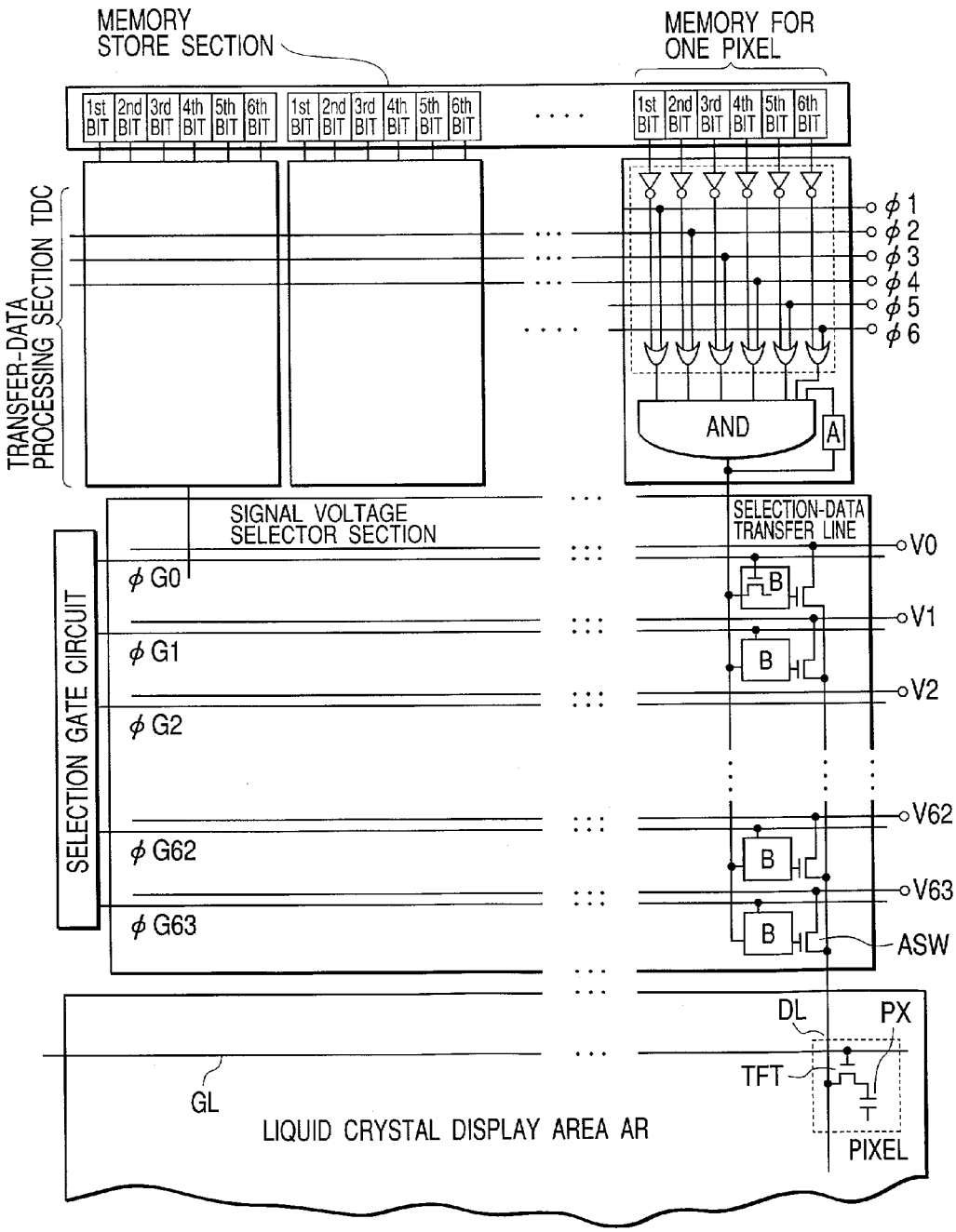
FIG. 7 is a detailed circuit diagram of another embodiment of a video signal drive circuit in accordance with the present invention.

FIG. 7 illustrates a configuration of another embodiment of the liquid crystal display device in accordance with the present invention, and the configuration is similar to that in FIG. 2. The same reference characters as utilized in FIG. 2 designate functionally similar parts in FIG. 7.

The configuration in FIG. 7 differs from that of FIG. 2, in that six-bit information data is utilized for one pixel, and thereby color display of sixty-four gray scale levels is realized. In this case, each of the six information bits is input to one terminal of a corresponding one of six OR circuits via a corresponding one of six inverters, and the other terminal of each of the six OR circuits is supplied with pulses Ø1, Ø2, Ø3, Ø4, Ø5 and Ø6 in the order from the most significant bit. Sixty-four circuit blocks B are provided for the output of one AND circuit, and control the opening and closing of analog switches ASW between corresponding ones of gray-scale signal voltage lines and one drain signal line DL based upon the output of the AND circuit. This means that the present invention is applicable to the display device irrespective of the number of information data bits for one pixel.

Embodiment 3

Figure 8:
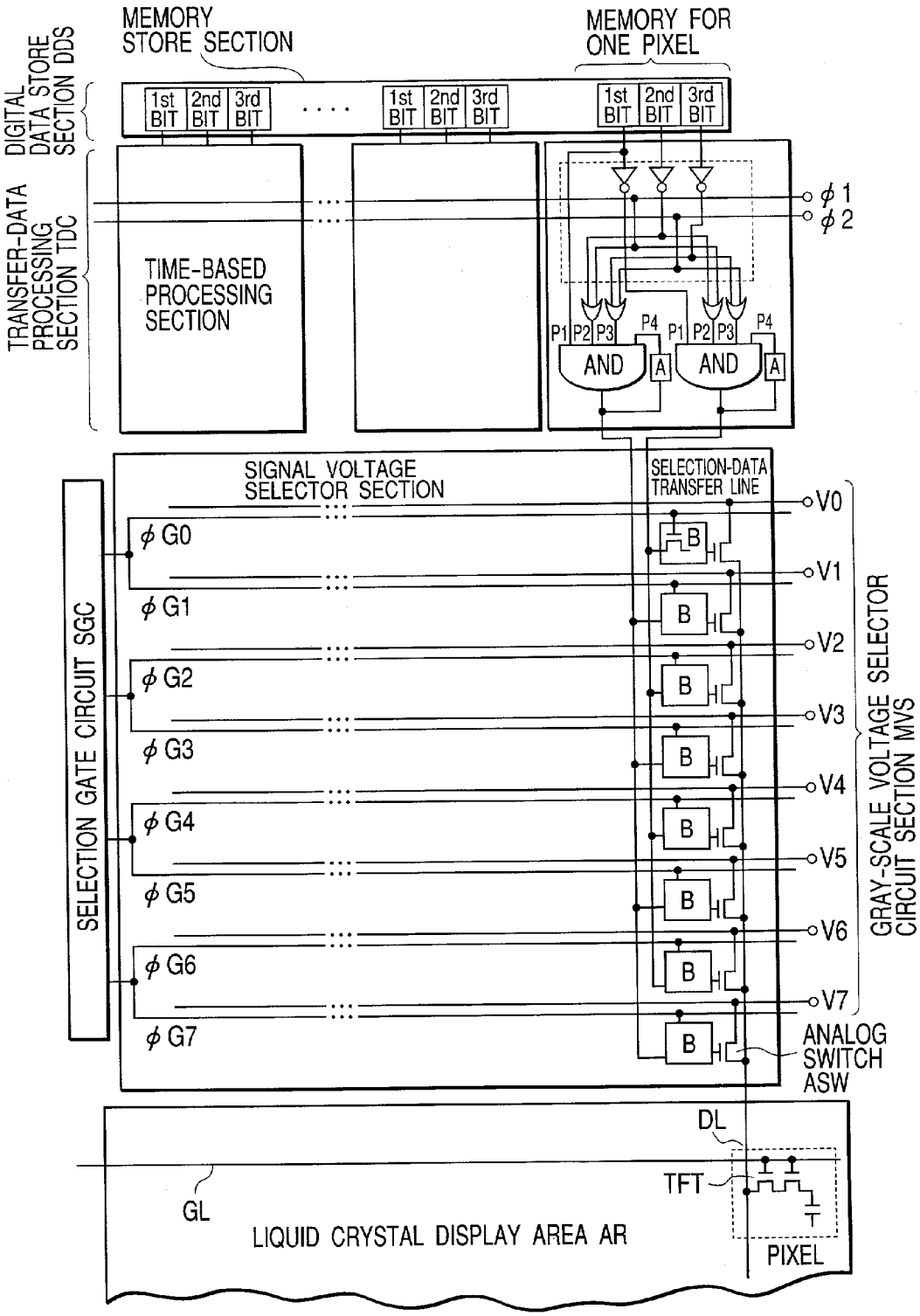
FIG. 8 is a detailed circuit diagram of another embodiment of a video signal drive circuit in accordance with the present invention.

FIG. 8 illustrates a configuration of another embodiment of the liquid crystal display device in accordance with the present invention, and the configuration is similar to that in FIG. 2. The same reference characters as utilized in FIG. 2 designate functionally similar parts in FIG. 8.

In the Embodiment explained in connection with FIG. 2, each of the circuit blocks B in the gray-scale voltage selector circuit section MVS is supplied with signals via only one AND circuit from the transfer-data processing section TDC. In other words, the plural circuit blocks B are connected to the AND circuit with one line (one selection-data transfer line). However, as shown in FIG. 8, the transfer-data processing section TDC can be configured to generate two signals such that one of the two signals is supplied to odd-numbered ones of the circuit blocks B, and the other of the two signals is supplied to even-numbered ones of the circuit blocks B, for example. In this case, two pairs each composed of the AND circuit and the circuit block A connected thereto are provided in each of the time-based processing sections of the transfer-data processing section TDC, and thereby information bits from the digital data store section DDS are distributed to the circuit blocks B.

In this configuration, two lines are required for each pixel for the purpose of connecting the transfer-data processing section TDS to the gray-scale voltage selector circuit section MVS, but thereby this configuration provides an advantage of slowing down the speed of the signals passing through the whole circuits.

Similarly, a plurality of circuit blocks B of the gray-scale voltage selector circuit section MVS can be divided into three or more groups, one AND circuit can be provided for each of the groups, and information bits from the digital data store section DDS can be distributed to the AND circuits in the transfer-data processing section TDC, and thereby the output of each of the AND circuits can be supplied to a corresponding one of the groups of the circuit blocks B. When information supplied to the digital data store section DDS is represented by three bits, for example, if a plurality of circuit blocks B is divided into a number of groups smaller than $2^3$, the number of wiring lines can be made smaller than in the case of conventional techniques.

While the above embodiments have been explained in connection with the drive circuits such as the video signal drive circuit fabricated on the transparent substrate SUB1 like the thin film transistors TFT, it is needless to say that the present invention is not limited to this configuration. Even in a case where initially the above-explained video signal drive circuit He is fabricated as a separate semiconductor device and then the semiconductor device is mounted on the transparent substrate SUB1, the present invention is applicable to the semiconductor device.

In the above embodiments, the present invention is applied to the liquid crystal display devices, but the present invention is not to limited to the liquid crystal display device. It is needless to say that the present invention is also applicable to a display device employing light-emitting elements arranged in a matrix array, for example. In such light-emitting display devices, the basic operation of the video signal drive circuit is identical if gray-scale-generating voltages (gray-scale information) and gray-scale-generating-currents are interchanged.

As is apparent from the above explanation, the display device in accordance with the present invention makes possible selection of gray scale voltages represented by a large number of information bits by using a limited space.

What is claimed is:

1. A display device comprising:

a substrate;

a plurality of pixels arranged in a matrix array and formed on said substrate;

a selector circuit for selecting one from a plurality of rows of pixels in said matrix array; and a video signal supplying circuit for supplying a video signal to each of pixels in said selected row in synchronism with said selection of said selected row, said video signal supplying circuit comprising:

a digital data store section for storing n-bit data information for each of said plurality of pixels, n being an integer equal to or greater than 3;

a transfer-data processing section for generating a data signal at a time assigned to one of a plurality of gray scale levels represented by said n-bit data information, in accordance with an output from said digital data store section, in synchronism with n kinds of clocks supplied to said transfer-data processing section, said n kinds being equal in number to the number of bits representing said n-bit data information, n being an integer equal to or greater than 3;

a gray-scale voltage generator for generating a plurality of gray scale voltages corresponding to said plurality of gray scale levels, respectively;

a selection gate circuit for successively generating a plurality of gate pulses associated with said plurality of gray-scale voltages, respectively, in synchronism with a fastest kind of said n kinds of clocks; and a gray-scale voltage selector circuit section comprised of TFTs (Thin Film Transistors) formed on said substrate for receiving said data signal via one or more selection-data transfer lines smaller in number than $2^n$ formed on said substrate corresponding to each of a plurality of columns of pixels in said matrix array, and for successively selecting said plurality of gray-scale voltages generated by said gray-scale voltage generator, in synchronism with said gate pulses, n being an integer equal to or greater than 3, wherein said gray-scale voltage selector circuit section outputs as said video signal, one of said plurality of gray-scale voltages selected from said successively selected gray-scale voltages in synchronism with said data signal.

2. A display device comprising:

a substrate;

a plurality of pixels arranged in a matrix array and formed on said substrate;

a selector circuit for selecting one from a plurality of rows of pixels in said matrix array; and a video signal supplying circuit for supplying a video signal to each of pixels in said selected row in synchronism with said selection of said selected row, said video signal supplying circuit comprising:

a digital data store section for storing n-bit data information for each of said plurality of pixels, n being an integer equal to or greater than 3;

a transfer-data processing section for generating a data signal at a time assigned to one of a plurality of gray scale levels represented by said n-bit data information, in accordance with an output from said digital data store section, in synchronism with n kinds of clocks supplied to said transfer-data processing section, said n kinds being equal in number to the number of bits representing said n-bit data information, and n being an integer equal to or greater than 3;

a gray-scale voltage generator for generating a plurality of gray-scale voltages corresponding to said plurality of gray scale levels, respectively;

a selection gate circuit for successively generating a plurality of gate pulses associated with said plurality of gray-scale voltages, respectively, in synchronism with a fastest kind of said n kinds of clocks; and a gray-scale voltage selector circuit section comprised of TFTs (Thin Film Transistors) formed on said substrate for receiving said data signal via one or more selection-data transfer lines smaller in number than $2^n$, said one or more selection-data transfer lines being formed on said substrate corresponding to each of a plurality of columns of pixels in said matrix array, and for successively selecting said plurality of gray-scale voltages generated by said gray-scale voltage generator, in synchronism with said gate pulses, n being an integer equal to or greater than 3, each of said plurality of selection-data transfer lines corresponding to one of a plurality of groups formed by dividing said plurality of gray-scale voltages, wherein said gray-scale voltage selector circuit section outputs as said video signal, one of said plurality of gray-scale voltages selected from said successively selected gray-scale voltages in synchronism with said data signal.

3. A display device according to claim 2, wherein said one or more selection-data transfer lines are smaller in number than said plurality of gray scale levels, and frequencies of said n kinds of clocks are successively lower or higher by a factor of 2.

4. A display device according to claim 1, wherein said n kinds of clocks include at least said fastest kind and a kind having a frequency equal to that of said fastest kind divided by $2^{(m-1)}$, where m is an integer from 2 to n, and n is an integer equal to or greater than 3.

5. A display device according to claim 1, wherein said display device is a liquid crystal display device.

6. A display device according to claim 1, wherein each of the plurality of pixels comprises a semiconductor layer which is formed of polysilicon.

7. A display device according to claim 6, wherein said TFTs of the gray-scale voltage selector circuit section comprise a semiconductor layer which is formed of polysilicon disposed on the substrate.

8. A display device according to claim 7, wherein the selection gate circuit comprises a semiconductor layer which is formed of polysilicon disposed on the substrate.

9. A display device according to claim 7, wherein the transfer-data processing section comprises a semiconductor layer which is formed of polysilicon disposed on the substrate.

10. A display device according to claim 3, wherein the display device is a liquid crystal display device.

11. A display device according to claim 3, wherein each of the plurality of pixels is provided with a light-emitting element.

12. A display device according to claim 3, wherein each of the plurality of pixels comprises a semiconductor layer which is formed of polysilicon.

13. A display device according to claim 12, wherein the TFTs of the gray-scale voltage selector circuit section comprises a semiconductor layer which is formed of polysilicon disposed on the substrate.

14. A display device according to claim 13, wherein the selection gate circuit comprises a semiconductor layer which is formed of polysilicon disposed on the substrate.

15. A display device according to claim 13, wherein the transfer-data processing section comprises a semiconductor layer which is formed of polysilicon disposed on the substrate.

16. A display device comprising:

a substrate;

a plurality of pixels arranged in a matrix array and formed on said substrate;

a selector circuit for selecting one from a plurality of rows of pixels in said matrix array; and a video signal supplying circuit for supplying a video signal to each of pixels in said selected row in synchronism with said selection of said selected row, said video signal supplying circuit comprising:

a digital data store section for storing n-bit data information for each of said plurality of pixels, n being an integer equal to or greater than 3;

a transfer-data processing section for generating a data signal at a time assigned to one of a plurality of gray scale levels represented by said n-bit data information, in accordance with an output from said digital data store section, in synchronism with n kinds of clocks supplied to said transfer-data processing section, said n kinds being equal in number to the number of bits representing said n-bit data information, n being an integer equal to or greater than 3;

a gray-scale voltage generator for generating a plurality of gray scale voltages corresponding to said plurality of gray scale levels, respectively;

a selection gate circuit for successively generating a plurality of gate pulses associated with said plurality of gray-scale voltages, respectively, in synchronism with a fastest kind of said n kinds of clocks; and a gray-scale voltage selector circuit section comprised of TFTs (Thin Film Transistors) formed on said substrate for receiving said data signal via only a singular selection-data transfer line formed on said substrate corresponding to each of a plurality of columns of pixels in said matrix array, and for successively selecting said plurality of gray-scale voltages generated by said gray-scale voltage generator, in synchronism with said gate pulses, wherein said gray-scale voltage selector circuit section outputs as said video signal, one of said plurality of gray-scale voltages selected from said successively selected gray-scale voltages in synchronism with said data signal.

17. A display device comprising:

a substrate;

a plurality of pixels arranged in a matrix array and formed on said substrate;

a selector circuit for selecting one from a plurality of rows of pixels in said matrix array; and a video signal supplying circuit for supplying a video signal to each of pixels in said selected row in synchronism with said selection of said selected row, said video signal supplying circuit comprising:

a digital data store section for storing n-bit data information for each of said plurality of pixels, n being an integer equal to or greater than 3;

a transfer-data processing section for generating a data signal at a time assigned to one of a plurality of gray scale levels represented by said n-bit data information, in accordance with an output from said digital data store section, in synchronism with clocks supplied to said transfer-data processing section;

a gray-scale voltage generator for generating a plurality of gray scale voltages corresponding to said plurality of gray scale levels, respectively;

a selection gate circuit for successively generating a plurality of gate pulses associated with said plurality of gray-scale voltages, respectively, in synchronism with a fastest kind of said clocks; and a gray-scale voltage selector circuit section comprised of TFTs (Thin Film Transistors) formed on said substrate for receiving said data signal via one or more selection-data transfer lines smaller in number than $2^n$ formed on said substrate corresponding to each of a plurality of columns of pixels in said matrix array, and for successively selecting said plurality of gray-scale voltages generated by said gray-scale voltage generator, in synchronism with said gate pulses, n being an integer equal to or greater than 3, wherein said gray-scale voltage selector circuit section outputs as said video signal, one of said plurality of gray-scale voltages selected from said successively selected gray-scale voltages in synchronism with said data signal.

* * * * *